US008617639B2

(12) United States Patent
Nakajima et al.

(10) Patent No.: US 8,617,639 B2
(45) Date of Patent: Dec. 31, 2013

(54) GOLF BALL MANUFACTURING METHOD

(75) Inventors: Tsuyoshi Nakajima, Chichibushi (JP); Takashi Ohira, Chichibushi (JP); Takuma Nakagawa, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 13/285,574

(22) Filed: Oct. 31, 2011

(65) Prior Publication Data

US 2013/0108783 A1 May 2, 2013

(51) Int. Cl.
*B05D 3/00* (2006.01)

(52) U.S. Cl.
USPC ..... 427/64

(58) Field of Classification Search
USPC ..... 427/64
See application file for complete search history.

(56) References Cited

U.S. PATENT DOCUMENTS

| | | | | |
|---|---|---|---|---|
| 5,542,680 | A * | 8/1996 | Proudfit et al. | 473/378 |
| 6,200,512 | B1 * | 3/2001 | Dewanjee et al. | 264/250 |
| 2001/0044079 | A1 * | 11/2001 | Park et al. | 430/321 |
| 2004/0266553 | A1 | 12/2004 | Park et al. | |
| 2004/0266554 | A1 | 12/2004 | Park et al. | |
| 2008/0061236 | A1 * | 3/2008 | Meredith et al. | 250/338.1 |

FOREIGN PATENT DOCUMENTS

JP 2007136171 A 6/2007

* cited by examiner

*Primary Examiner* — Robert Vetere
(74) *Attorney, Agent, or Firm* — Sughrue Mion, PLLC

(57) ABSTRACT

A method of manufacturing golf balls having a highly transparent cover includes, prior to formation of the cover, a preformed body fabricating step wherein a fluorescent material that emits light when exposed to ultraviolet radiation is included in or coated onto the preformed body. In this way, a preformed body which matches a cover to be formed can be easily and reliably identified from among a plurality of types of preformed bodies stored at a temporary storage place. This manufacturing method enables golf balls of excellent visibility and stylishness to be efficiently produced.

12 Claims, No Drawings

GOLF BALL MANUFACTURING METHOD

BACKGROUND OF THE INVENTION

The present invention relates to a method of manufacturing golf balls having a core, a cover and, optionally, one or more intermediate layer between the core and the cover. More particularly, the invention relates to a golf ball manufacturing method which can be advantageously employed to produce very stylish golf balls having highly transparent covers.

Golf ball development has hitherto been focused primarily on improving the basic performance of the ball, such as the distance, controllability, durability and feel on impact. From the standpoint of visibility and other considerations, the color of the ball has been predominantly white, which is an expansive color.

However, the base of golfers has expanded recently to include also young adults and women, leading to a rise in demand for golf balls which not only satisfy the basic performance requirements, but also have a distinctive appearance and convey a sense of the golfer's individuality. In response to such a demand, golf balls having an unusual appearance, such as golf balls which change in color when exposed to ultraviolet radiation (published U.S. Patent Application No. 2004/0266553) and golf balls which use phosphorescent pigments (published U.S. Patent Application No. 2004/0266554), have hitherto been described by golf ball suppliers.

The present applicant earlier disclosed, in JP-A 2007-136171, a golf ball which, in order to enhance the visibility and stylishness of the ball, has the quality of changing color (photochromism) depending on the type of light that strikes the ball.

In addition, golf balls with a cover made of transparent or translucent resin formed over either a core or a sphere composed of a core encased by one or more intermediate layer have been disclosed as highly stylish golf balls of distinctive appearance. Such balls often have a sense of transparency and leave the consumer with an impression of quality and elegance. By also mixing a pigment into the resin, unprecedentedly bright colors can be expressed.

However, in the foregoing golf balls having a highly transparent cover, the ball coloration is sometimes affected by the color of the layer in contact with the cover on the inside thereof (in the present invention, this layer refers to the core or the outermost intermediate layer, and is denoted below as the "layer adjacent to the cover"). For example, when a highly transparent material is used to form a cover over a core having dark gray color, the color of the core ends up being visible through the cover. In such a case, even when the cover has been colored to some degree, the core color cannot be completely hidden; as a result, the ball coloration ends up being tinged with gray. On the other hand, if a large amount of pigment, filler and the like is included in the above material so as to completely hide the color of the core, the resulting ball loses its transparent feel, making it difficult to achieve a bright color. In such cases, to reduce the influence by the color of the layer adjacent to the cover on the ball coloration, it is common to have this layer be white.

In order to respond to the diverse needs of the market, golf ball production at a manufacturing plant ordinarily involves the concurrent production of a plurality of types of golf balls having different performance characteristics such as distance and controllability. From a production control standpoint, the preformed body fabricated prior to formation of the cover is often transferred to a temporary storage place following fabrication and stored until such time as the cover is formed. The preformed body which matches the cover to be formed is then selected from among a plurality of types of preformed bodies stored at the temporary storage place, and supplied to the cover-forming step. In golf balls having a normal white color, the preformed bodies can easily be distinguished from one another by varying the color of the preformed body for each type of ball. In the present invention, "preformed body" refers to a core or a sphere composed of a core encased by one or more intermediate layer. Also, the outermost layer of such a preformed body corresponds to the "layer adjacent to the cover" as defined above.

In golf balls having a highly transparent cover, to keep the color of the preformed body from affecting coloration of the ball following cover formation, all the preformed bodies are fabricated so as to be white under visible light, regardless of the type thereof. As a result, the preformed bodies stored at a temporary storage place, in spite of minor differences by type in such properties as diameter and weight, are substantially identical in appearance. Hence, when selecting preformed bodies to be fed to the cover-forming step, it is difficult to distinguish between the different types based on their appearance. In the past, the preformed body matching a cover to be formed has been identified and selected from a plurality of types by checking the diameter and weight each time, but such identification is time-consuming, lowering productivity. Moreover, should the wrong type of preformed body be selected, the result is a defective product.

Accordingly, in the production of the above-described golf balls having a highly transparent cover, from the standpoint of improving productivity, there exists a desire for a way to easily and reliably identify, from among preformed bodies of different types but the same color, a preformed body which matches the cover to be formed.

SUMMARY OF THE INVENTION

It is therefore an object of the present invention to provide a golf ball manufacturing method which is capable of efficiently, and without detriment to the ball coloration, producing very stylish golf balls having a highly transparent cover.

In order to achieve the above object, the inventors here disclose a method for manufacturing golf balls having a highly transparent cover. The method includes, prior to formation of the cover, a preformed body fabricating step wherein a fluorescent material that emits light when exposed to ultraviolet radiation is included in or coated onto the preformed body. In this way, a preformed body which matches a cover to be formed can be easily and reliably identified from among a plurality of types of preformed bodies stored at a temporary storage place, enabling productivity to be increased.

Accordingly, the invention provides the following golf ball manufacturing method.

[1] A method of manufacturing a golf ball having a core, a cover and, optionally, one or more intermediate layer between the core and the cover, which cover is formed of a transparent or translucent material or a material obtained by blending a colorant in a transparent or translucent material, the method comprising the steps of:

fabricating a preformed body which is a core or a sphere comprising a core over which one or more intermediate layer has been formed;

transferring the preformed body to a temporary storage place;

selecting a preformed body matching a cover to be formed from among a plurality of preformed bodies stored at the temporary storage place;

transferring the selected preformed body to a cover-forming step;

forming a cover over the preformed body transferred from the temporary storage place;

in the preformed body fabricating step, including in or coating onto the preformed body a fluorescent material that fluoresces when exposed to ultraviolet radiation; and in the preformed body selecting step, exposing the preformed bodies stored at the temporary storage place to ultraviolet radiation so as to generate a fluorescent color, and identifying by the color a preformed body matching the cover to be formed.

[2] The golf ball manufacturing method of [1], wherein the preformed body is a body selected from the group consisting of:

a core formed of a material containing a fluorescent material;

a sphere obtained by forming one or more intermediate layer over a core, wherein an outermost intermediate layer is formed of a material containing a fluorescent material;

a core which has been coated on all or part of a surface thereof with a material containing a fluorescent material; and a sphere obtained by forming one or more intermediate layer over a core, wherein an outermost intermediate layer has been coated on all or part of a surface thereof with a material containing a fluorescent material.

[3] The golf ball manufacturing method of [1], wherein the fluorescent material is one or more material selected from among inorganic phosphors containing an element selected from the group consisting of alkaline earth metals, zinc family elements, transition metals and lanthanide metals, and organic phosphors selected from the group consisting of compounds having fluorene skeletons.

DETAILED DESCRIPTION OF THE INVENTION

The golf ball manufacturing method of the invention is described more fully below.

The inventive method is a method of manufacturing a golf ball having a core, a cover and, optionally, one or more intermediate layer between the core and the cover, which cover is formed of a transparent or translucent material or a material obtained by blending a colorant with a transparent or translucent material.

The method includes the steps of: fabricating a core or a sphere composed of a core over which one or more intermediate layer has been formed (which core or sphere is referred to herein as a "preformed body");

transferring the preformed body to a temporary storage place;

selecting a preformed body matching a cover to be formed from among a plurality of preformed bodies stored at the temporary storage place;

transferring the selected preformed body to a cover-forming step; and forming a cover over the preformed body transferred from the temporary storage place.

In addition, the manufacturing method of the invention includes also the steps of: in the preformed body fabricating step prior to formation of the cover, including in or coating onto the preformed body a fluorescent material that fluoresces when exposed to ultraviolet radiation; and, in the step of selecting a preformed body matching a cover to be formed from among a plurality of preformed bodies stored at the temporary storage place, exposing the preformed bodies stored at the temporary storage place to ultraviolet radiation so as to generate a fluorescent color, and identifying by the color a preformed body to be supplied to the cover-forming step.

As with conventional golf balls, the construction of the golf ball manufactured by the method of the invention may be suitably set according the target performance, and is not subject to any particular limitation. That is, the golf ball may be, as appropriate, a two-piece solid golf ball obtained by forming a cover over a solid core, or a multi-piece solid golf ball which has a construction of three or more pieces and is obtained by forming one or more intermediate layer between the solid core and the cover.

In the step of fabricating a core or a sphere composed of a core over which one or more intermediate layer has been formed (preformed body), the core and intermediate layer may be fabricated by a known molding method such as compression molding or injection molding. The core and intermediate layer are described in detail below.

The core is obtained by vulcanizing a rubber composition composed primarily of a rubber material. Specifically, use may be made of a rubber composition containing, for example, a base rubber, a crosslinking initiator and a co-crosslinking agent.

The base rubber of the rubber composition is not subject to any particular limitation, although the use of polybutadiene is preferred. Preferred use may be made of cis-1,4 polybutadiene having a cis structure content of at least 40%. If so desired, in the base rubber, other rubbers such as natural rubber, polyisoprene rubber or styrene-butadiene rubber may be suitably compounded with the above polybutadiene. The golf ball rebound can be elevated by increasing the amount of rubber components.

Preferred use may be made of an organic peroxide as the crosslinking initiator in the invention. Illustrative examples of suitable organic peroxides include 1,1-bis-t-butylperoxy-3,3,5-trimethylcyclohexane, dicumyl peroxide, di(t-butylperoxy)-meta-diisopropylbenzene and 2,5-dimethyl-2,5-di-t-butylperoxyhexane. A commercial product may be used as the organic peroxide. Examples of such products include Percumyl D (available from NOF Corporation) and Trigonox 29-40 (available from Kayaku Akzo Corporation). These crosslinking initiators are compounded in an amount which, although not subject to any particular limitation, is preferably at least 0.1 part by weight, and more preferably at least 0.5 part by weight, per 100 parts by weight of the base rubber. The upper limit is preferably not more than 5 parts by weight, and more preferably not more than 2 parts by weight.

The co-crosslinking agent used in the invention may be, for example, a metal salt of an unsaturated fatty acid such as methacrylic acid or acrylic acid (e.g., zinc salts, magnesium salts, calcium salts), or an ester compound such as trimethylolpropane trimethacrylate. To obtain a high rebound in particular, preferred use may be made of zinc acrylate. The amount of such co-crosslinking agents included per 100 parts by weight of the base rubber, although not subject to any particular limitation, may be set to at least 10 parts by weight, and preferably at least 15 parts by weight, but not more than 50 parts by weight, and preferably not more than 40 parts by weight.

In addition, various types of additives may be optionally included in the above composition, examples of such additives being sulfur, antioxidant, zinc oxide, barium sulfate, the zinc salt of pentachlorothiophenol and zinc stearate. No particular limitation is imposed on the amounts in which these additives are included.

The core diameter, although not subject to any particular limitation, may be set to preferably at least 32.0 mm, and more preferably at least 33.0 mm, but preferably not more than 40.5 mm, and more preferably not more than 39.5 mm.

The core has a deflection when compressed under a final load of 1,275 N (130 kgf) from an initial load of 98 N (10 kgf) which, although not subject to any particular limitation, may be set in a range of from 2.5 to 5.0 mm, preferably from 3.0 to 4.5 mm, and more preferably from 3.5 to 4.0 mm. If the core deflection is too small, the feel of the ball on impact when struck with a driver may be too hard and the scuff resistance may worsen. On the other hand, if the core deflection is too large, the feel when struck with a driver may be too soft and the distance traveled by the ball may decrease markedly.

The rubber composition may be prepared by using a known mixer (e.g., a Banbury mixer, kneader, or roll mill) to mix each of the above ingredients. Moreover, a known method such as compression molding may be advantageously employed to form a solid core using the rubber composition prepared as described above.

The description thus far is the same as for a conventional core. However, in cases where the above core is intended for use as a preformed body, in order to carry out the manufacturing method of the invention, it is critical that all or part of the core surface fluoresce when exposed to ultraviolet radiation. The means for having the above core fluoresce when exposed to ultraviolet radiation is described below. In this case, the core has a white color under ordinary visible light. Also, the resulting golf ball is a two-piece solid golf ball having a single cover layer formed over the core.

In the present invention, a fluorescent material is used in order to have the above core (preformed body) which appears white under ordinary visible light fluoresce when exposed to ultraviolet radiation. This fluorescent material is a material which has a white color when exposed to visible light, and which reacts to ultraviolet light by fluorescing a specific color. In the practice of the invention, one or more of the subsequently described inorganic phosphors and organic phosphors may be used as the fluorescent material.

In the invention, the inorganic phosphor is preferably one which includes an element selected from the group consisting of alkaline earth metals, zinc family elements, transition metals and lanthanide metals. More specifically, preferred use may be made of an inorganic phosphor which includes as the primary ingredient a high-purity oxide, sulfate, silicate, tungstate or the like of a metal such as zinc, cadmium, calcium, aluminum or yttrium, and is obtained by adding small amounts of an activator such as manganese, silver, copper or lead and a flux, and firing at an elevated temperature. Illustrative examples of such inorganic phosphors include red-emitting inorganic phosphors such as $Y_2O_3$:Eu, $YVO_4$:Eu, $Y_2O_2S$:Eu, $Y_2O_2S$:Eu,Sm, and $0.5MgF_2.3.5MgO.GeO_2$:Mn; green-emitting inorganic phosphors such as ZnS:Cu,Al, (Zn, Cd)S:Cu,Al, ZnS:Cu,Au,Al, $3(Ba,Mg)O.8Al_2O_3$:Eu,Mn, and $Zn_2GeO_4$:Mn; blue-emitting inorganic phosphors such as ZnS:Ag, $CaWO_4$, $Sr_2P_2O_7$:Eu, and $3(Ba,Mg)O.8Al_2O_3$:Eu; violet-emitting inorganic phosphors such as CaS:Bi; yellow-green-emitting inorganic phosphors such as ZnS:Cu; and orange-emitting inorganic phosphors such as ZnS:Mn. In this invention, preferred use may be made of the above inorganic phosphors because they have an excellent heat resistance and do not change in color at the time of manufacture.

The aforementioned organic phosphor is a naturally occurring organic compound or a synthetic organic compound. In the present invention, preferred use may be made of an organic phosphor selected from among compounds having a fluorene skeleton, such as fluorene and fluorenone.

Commercial products may be used as the above fluorescent materials. In the present invention, preferred use can be made of Lumilux Effect (available from Honeywell International) and Hikari☆Color (available from TDO Graphics). In the case of Hikari☆Color in particular, preferred use may be made of, for example, the products having the product number designations REF-10RM, REF-10GM and REF10BM.

Use of the above fluorescent materials in the manufacturing method of the invention may be carried out by employing a method which involves compounding the fluorescent material in the above rubber composition, or a method which involves coating all or part of the surface of a core fabricated of the above-described rubber composition (which does not contain the fluorescent material) with a paint containing the fluorescent material.

When the fluorescent material is compounded in the above rubber composition, the required amount thereof may be suitably compounded in the same way as the other ingredients of the rubber composition. The amount of fluorescent material included, although not subject to any particular limitation, may be set to preferably at least 0.1 part by weight, more preferably at least 0.3 part by weight, and even more preferably at least 0.5 part by weight, per 100 parts by weight of the base rubber. The upper limit is preferably not more than 5 parts by weight, more preferably not more than 3 parts by weight, and even more preferably not more than 2 parts by weight, per 100 parts by weight of the base rubber. If too little fluorescent material is included, light emission when exposed to ultraviolet radiation will be weak, which may make a distinguishability improving effect difficult to achieve. On the other hand, including too much fluorescent material may lead to increased costs or may have undesirable effects on the ball properties.

In cases where all or part of the core surface is coated, the paint used is not subject to any particular limitation, although the use of a urethane paint is preferred in the present invention. In this case, the amount of fluorescent material included with respect to the paint is set in a range of preferably from 0.1 to 50 parts by weight, and more preferably from 0.5 to 30 parts by weight, per 100 parts by weight of the paint. If too little fluorescent material is included, the fluorescence upon exposure to ultraviolet radiation will be weak, which may make a distinguishability improving effect difficult to achieve. On the other hand, including too much fluorescent material may lead to increased costs or have undesirable effects on the ball properties.

The coating method is not subject to any particular limitation. For example, a known method such as spray painting or brush painting may be used. Alternatively, if only part of the core surface is to be coated, markings in the form of suitable letters, numbers, symbols and the like may be applied with the above paint. In cases where markings are applied, the method for doing so is not subject to any particular limitation, although a known method such as pad printing or masking and painting may be used. To increase adhesion of the paint to the core, the surface of the core may be subjected to some form of pretreatment, such as blasting, primer treatment, plasma treatment or corona discharge treatment.

The core (preformed body) which has been fabricated in this way appears white under ordinary visible light, but all or some of the surface fluoresces when the core is exposed to ultraviolet radiation. Hence, even when a plurality of types of preformed bodies are stored at a temporary storage place, exposing the bodies to ultraviolet radiation using a known UV irradiator causes them to fluoresce in a specific color, enabling the preformed bodies to be easily and reliably identified by the color of the fluorescence or the fluorescent markings that appear. Moreover, because the fluorescent color is not given off under sunlight or fluorescent lighting, the ball remains white, as a result of which the ball coloration following formation of the cover is not affected.

In the present invention, the intermediate layer is a layer which is optionally formed between the core and the cover. In cases where the golf ball to be manufactured has an intermediate layer, the preformed body is a sphere obtained by forming one or more intermediate layer over a core. The resulting golf ball is a multi-piece solid golf ball having a structure composed of three or more pieces. No particular limitation is imposed on the method of molding the intermediate layer, although use may be made of a known molding method such as injection molding or compression molding. For example, when injection molding is carried out, the fabricated core may be set in a mold, and an intermediate layer-forming material may be injected into the mold according to a conventional method. In cases where the intermediate layer described above is formed, there is no particular need to use a fluorescent material in the solid core.

A thermoplastic resin or a thermoplastic elastomer may be preferably used as the base resin in the intermediate layer-forming material. Exemplary thermoplastic resins include ionomer resins. A commercial product may be used as the ionomer resin. Illustrative examples of commercial ionomer resins that may be used in the practice of the invention include Himilan resins (available from DuPont-Mitsui Polychemicals Co., Ltd.), Surlyn resins (available from E.I. DuPont de Nemours & Co.) and Iotek (available from Exxon). Illustrative examples of thermoplastic elastomers include polyester-type thermoplastic elastomers, polyamide-type thermoplastic elastomers, polyurethane-type thermoplastic elastomers, olefin-type thermoplastic elastomers, and styrene-type thermoplastic elastomers. A commercial product may be used as the thermoplastic elastomer, Illustrative examples of commercial thermoplastic elastomers that may be used in the practice of the invention include Hytrel resins (available from DuPont-Toray Co., Ltd.), Pelprene (available from Toyobo Co., Ltd.), Pebax (available from Toray Industries, Inc.), Pandex (available from DIC Corporation), Santoprene (available from Monsanto Chemical Co.), Tuftec (available from Asahi Chemical Industry Co., Ltd.), and Dynaron (available from JSR Corporation). In this invention, preferred use may be made of an ionomer resin or a thermoplastic polyurethane elastomer as the above thermoplastic resin or thermoplastic elastomer.

When a thermoplastic resin is used as the base resin, although not subject to any particular limitation, the melt flow index of the thermoplastic resin is preferably at least 0.5 g/10 min. The thermoplastic resin has a material hardness, expressed as the Shore D hardness, which, although not subject to any particular limitation, is preferably at least 40. Here, "material hardness" refers to the hardness of a 2 mm-thick sheet obtained by press-molding the material to be measured, which hardness is measured using a type D durometer in general accordance with ASTM D2240. Moreover, although not subject to any particular limitation, the material has a rebound resilience, as measured in general accordance with JIS-K7311, of preferably at least 30%.

The intermediate layer has a material hardness, expressed as the Shore D hardness, which, although not subject to any particular limitation, is preferably at least 45, and more preferably at least 48. The upper limit in the Shore D hardness is preferably not more than 55, and more preferably not more than 53. If the material hardness of the intermediate layer is too low, the ball rebound may be poor, possibly lowering the distance of the ball. On the other hand, too high a material hardness may worsen the feel on impact or worsen the scuff resistance.

The thickness of the intermediate layer, although not subject to any particular limitation, may be set to preferably at least 0.8 mm, and more preferably at least 1.2 mm. The upper limit in thickness is preferably not more than 2.2 mm, and more preferably not more than 1.8 mm. If the intermediate layer is too thin, the durability to cracking on repeated impact may worsen. On the other hand, if the intermediate layer is too thick, the ball rebound may decrease, resulting in a shorter distance.

In the manufacturing method of the invention, a fluorescent material is used in order to have the sphere (preformed body), which has been obtained by forming one or more intermediate layer over the above-described core and appears white under ordinary visible light, fluoresce when exposed to ultraviolet radiation. The fluorescent material used for this purpose may be of the same type as those mentioned above by way of example.

In the manufacturing method of the invention, the fluorescent material may be used by employing a method wherein the fluorescent material is compounded in the above-described intermediate layer-forming resin material, or by a method wherein all or part of the surface of the sphere obtained by using the above resin material (which contains no fluorescent material) to form an intermediate layer over the core is coated with a paint containing the fluorescent material.

When a fluorescent material is included in the above resin material, it may be suitably compounded in the required amount in the same way as the other ingredients of the resin material. The amount included, although not subject to any particular limitation, may be set to preferably at least 0.1 part by weight, more preferably at least 0.3 part by weight, and even more preferably at least 0.5 part by weight, per 100 parts by weight of the base resin. The upper limit per 100 parts by weight of the base resin is preferably not more than 5 parts by weight, more preferably not more than 3 parts by weight, and even more preferably not more than 2 parts by weight. If the amount of fluorescent material included is too small, fluorescence upon exposure to ultraviolet radiation will be weak, which may make a distinguishability improving effect difficult to obtain. On the other hand, including too much fluorescent material may lead to increased costs or may have undesirable effects on the ball properties. If a plurality of intermediate layers are to be formed, the fluorescent material should be included in the outermost of the intermediate layers (i.e., the layer adjacent to the cover).

In cases where a method is used wherein all or part of the surface of the sphere (preformed body) obtained by forming one or more intermediate layer over a core is coated with a paint containing a fluorescent material, any of the above-described methods may be employed as the coating method.

The sphere (preformed body) which has been fabricated in this way by forming one or more intermediate layer over the core appears white under ordinary visible light, but when exposed to ultraviolet radiation, all or part of the surface fluoresces. Hence, even when a plurality of types of preformed bodies are stored at a temporary storage place, by exposing the preformed bodies to ultraviolet radiation using a known UV irradiator, the bodies are made to fluoresce in a specific color, enabling easy and reliable identification by the color of the fluorescence or the fluorescent letters or other markings that appear. Moreover, under sunlight or fluorescent lighting, the ball does not give off a fluorescent color and remains white, as a result of which the ball coloration following formation of the cover is not affected.

The preformed body fabricated as described above (which body is a core or a sphere composed of a core over which one or more intermediate layer has been formed) is then transferred to a temporary storage place and there stored such time as it is supplied to the subsequently described cover-forming step. Numerous white preformed bodies of differing types are stored at the same temporary storage place. When a preformed body is needed, the stored bodies are exposed to ultraviolet radiation, causing the preformed bodies to fluoresce. A preformed body matching the cover to be formed is then identified and selected from the fluorescent color, and transferred to the cover-forming step.

The cover is the layer formed on the outermost side of the golf ball, and typically has a large number of dimples formed on the surface thereof. The cover is described in detail below.

A thermoplastic resin or a thermoplastic elastomer may be advantageously used as the base resin in the cover-forming material. Exemplary thermoplastic resins include ionomer resins. A commercial product may be used as the ionomer resin. Illustrative examples of commercial ionomer resins that may be used in the practice of the invention include Himilan resins (available from DuPont-Mitsui Polychemicals Co., Ltd.), Surlyn resins (available from E.I. DuPont de Nemours & Co.) and Iotek (available from Exxon). Illustrative examples of thermoplastic elastomers include polyester-type thermoplastic elastomers, polyamide-type thermoplastic elastomers, polyurethane-type thermoplastic elastomers, olefin-type thermoplastic elastomers, and styrene-type thermoplastic elastomers. A commercial product may be used as the thermoplastic elastomer, Illustrative examples of commercial thermoplastic elastomers that may be used in the practice of the invention include Hytrel resins (available from DuPont-Toray Co., Ltd.), Pelprene (available from Toyobo Co., Ltd.), Pebax (available from Toray Industries, Inc.), Pandex (available from DIC Corporation), Santoprene (available from Monsanto Chemical Co.), Tuftec (available from Asahi Chemical Industry Co., Ltd.), and Dynaron (available from JSR Corporation). In the practice of this invention, preferred use may be made of an ionomer resin or a thermoplastic polyurethane elastomer as the above thermoplastic resin or thermoplastic elastomer.

In cases where a thermoplastic resin is used as the base resin, although not subject to any particular limitation, the thermoplastic resin has a melt flow index of preferably at least 0.5 g/10 min. The thermoplastic resin has a material hardness, expressed as the Shore D hardness, which, although not subject to any particular limitation, is preferably at least 40. Moreover, although not subject to any particular limitation, the material has a rebound resilience, as measured in general accordance with JIS-K7311, of preferably at least 30%.

A transparent resin or translucent resin is preferably used as the base resin of the cover material. Moreover, color may be applied to the cover material by the suitable addition of colorants such as known fluorescent agents, pigments and dyes in order to make the ball brightly colored.

Examples of such colorants include, but are not limited to, light-harvesting dyes (pink), solvent yellow dyes, solvent orange dyes, anthraquinone dyes, phthalocyanine dyes, yellow fluorescent pigments, pink fluorescent pigments and orange fluorescent pigments. Known commercial products may be used as these colorants.

The above colorants are included in an amount which, although not subject to any particular limitation, is preferably in a range of from 0.001 to 0.4 part by weight per 100 parts by weight of the resin base. By keeping the amount of colorant within this range, the resistance of the overall ball to discoloration can be improved.

Inorganic fillers such as titanium oxide may be included within a range that is not detrimental to the cover transparency. The amount of such inorganic fillers, although not subject to any particular limitation, may be set to from 0.01 to 2 parts by weight per 100 parts by weight of the base resin.

Insofar as there is no loss of cover transparency, the cover material may also suitably include various additives other than the above-described inorganic fillers, such as ultraviolet absorbers, antioxidants and metal soaps.

The cover material may be conferred which a hardness, expressed as the Shore D hardness, which, although not subject to any particular limitation, is generally at least 40, and preferably at least 43. The upper limit in the Shore D hardness is generally not more than 62, and preferably not more than 60. If the material hardness is too high, a suitable spin rate may be difficult to achieve on approach shots, which may result in a poor controllability. On the other hand, if the material hardness is too low, the ball rebound may worsen, possibly shortening the distance of the ball.

The cover hardness, although not subject to any particular limitation, may be set to generally at least 0.5 mm, and preferably at least 0.8 mm. The upper limit is generally not more than 3.0 mm, and preferably not more than 2.2 mm. If the cover is too thin, a suitable spin performance may be difficult to achieve, or the durability to cracking on repeated impact may worsen. On the other hand, if the cover is too thick, the ball rebound may decrease, resulting in a shorter distance.

A known molding method such as injection molding or compression molding may be employed to form the cover over the preformed body using the above cover material. For example, in cases where injection molding is carried out, the preformed body that has been fabricated may be set within a mold and the above cover material injected into the mold by a conventional method.

Numerous dimples are generally formed on the surface of the cover that has been formed in the above manner. In addition, the surface of the cover may, for example, be clear coated and have markings applied thereto.

In cases where markings are applied to the surface of the cover, a commonly used method may be employed for this purpose. Illustrative examples include directing printing methods which include a pad printing step; and indirect printing methods such as a transfer method in which a stamp presses a transfer film with a solid covering of ink against the ball, a method in which ink is cast onto surface features (stamped areas, etc.) on the surface of the ball proper, and thermal transfer printing. The type, position and number of markings placed on the ball are not subject to any particular limitation. For example, markings such as letters, numbers, trade names and logos may be applied at any position on the ball. To increase adhesion between the markings and the cover, the surface of the ball may be subjected to some kind of pre-treatment, such as blasting, primer treatment, plasma treatment or corona discharge treatment, prior to application of the markings.

The paint used is not subject to any particular limitation, although the use of a urethane paint is generally preferred. The amount of colorant included in the paint, although not particularly limited, may be set to generally from 0.1 to 50 parts by weight, and preferably from 0.5 to 30 parts by weight.

The golf ball formed as described above has a deflection, when compressed under a final load of 1,275 N (130 kgf) from an initial load of 98 N (10 kgf), which, although not subject to any particular limitation, may be set to preferably at least 2.0 mm, more preferably at least 2.3 mm, and even more preferably at least 2.5 mm. The upper limit is preferably not more than 4.0 mm, more preferably not more than 3.5 mm, and even more preferably not more than 3.2 mm. If the ball deflection is too small, the feel on impact may be poor or, particularly on shots with an iron, the spin rate may rise excessively, possibly resulting in a large decrease in distance. On the other hand, if the ball deflection is too large, the ball rebound may be poor, resulting in a decreased distance, particularly on shots with a driver.

Golf balls manufactured by the method of the invention may be formed, in accordance with the Rules of Golf, to a diameter of preferably not less than 42.67 mm and a weight of preferably not more than 45.93 g.

As explained above, the inventive method of manufacturing golf balls having a highly transparent cover includes, prior to formation of the cover, a preformed body fabricating step wherein a fluorescent material that emits light when irradiated with ultraviolet light is included in or coated onto the preformed body. In this way, a preformed body which matches a cover to be formed can be easily and reliably identified from among a plurality of types of preformed bodies stored at a temporary storage place. This manufacturing method enables golf balls of excellent visibility and stylishness to be efficiently produced.

EXAMPLES

The manufacturing method of the invention is illustrated more fully below by way of the following Examples, although the Examples are not intended to limit the invention.

(1) Two-Piece Solid Golf Ball

First, the core-forming rubber compositions of Formulations 1 and 2 shown in Table 1 were prepared according to a conventional method, and the to resulting compositions were vulcanized at 155° C. for 15 minutes, thereby fabricating solid Cores 1 and 2 having a diameter of 38.3 mm. At this time, the inorganic phosphor REF-10RM which exhibits a red color when exposed to ultraviolet radiation was compounded in Core 1 and the inorganic phosphor REF-10GM which exhibits a green color when exposed to ultraviolet radiation was compounded in Core 2. These Cores 1 and 2 both appeared white under sunlight and fluorescent lighting.

TABLE 1

| | | Core 1 | Core 2 |
|---|---|---|---|
| Formulation (parts by weight) | Polybutadiene rubber | 100 | 100 |
| | Zinc acrylate | 29 | 32 |
| | Peroxide | 1.2 | 1.2 |
| | Antioxidant | 0.1 | 0.1 |
| | Zinc oxide | 26.7 | 21 |
| | Zinc salt of pentachlorothiophenol | 0.2 | 0.2 |
| | Inorganic phosphor 1 | 1 | |
| | Inorganic phosphor 2 | | 1 |

Details on the ingredients in Table 1 are given below.

| | |
|---|---|
| Polybutadiene rubber: | Available under the trade name "BR01" from JSR Corporation |
| Peroxide: | Mixture of 1,1-di(t-butylperoxy)cyclohexane and silica, available under the trade name "Perhexa C-40" from NOF Corporation |
| Antioxidant: | Available under the trade name "Nocrac NS-6" from Ouchi Shinko Chemical Industry Co., Ltd. |
| Inorganic Phosphor 1: | REF-10RM (red-emitting), available under the trade name Hikari☆Color from TDO Graphics |
| Inorganic Phosphor 2: | REF-10GM (green-emitting), available under the trade name Hikari☆Color from TDO Graphics |

When numerous cores of each type (Cores 1 and 2) that had been fabricated as described above were mixed together then exposed to ultraviolet radiation, one type of core (Core 1) emitted red light and the other type of core (Core 2) emitted green light, thus enabling the two types to be easily distinguished from each other.

Next, using materials formulated as shown in Table 2, covers having a thickness of 2.2 mm were injection-molded over the above Cores 1 and 2 by a conventional method, thereby producing two-piece solid golf balls. Cover 1 was paired with Core 1, and Cover 2 was paired with Core 2. When numerous white cores of both types (Cores 1 and 2) were mixed together, each type of core was easily identifiable by the fluorescent color emitted upon exposure to ultraviolet radiation. Hence, no mistakes were made in combining the cores and the covers. The resulting golf balls all had a bright orange color with a transparent feel, and were highly stylish.

TABLE 2

| | | Cover 1 | Cover 2 |
|---|---|---|---|
| Formulation (parts by weight) | Himilan 1605 | 50 | |
| | Himilan 1705 | 50 | |
| | Himilan 1557 | | 50 |
| | Himilan 1601 | | 50 |
| | Organic pigment (orange) | 0.98 | 0.98 |

Details of the ingredients in Table 2 are given below.

| | |
|---|---|
| Himilan 1605, 1705 1557, 1601: | Ionomer resins available from DuPont-Mitsui Polychemicals Co., Ltd. |
| Organic pigment (orange): | Available under the trade name "COL036-2774" from DIC Bayer Polymer, Ltd. |

(2) Three-Piece Solid Golf Ball

First, the core-forming rubber compositions of Formulations A and B shown in Table 3 were prepared by a conventional method, and the resulting compositions were vulcanized at 155° C. for 15 minutes, thereby fabricating solid cores A and B having a diameter of 37.3 mm. The above Cores A and B were colored different colors with pigments in order to distinguish between them.

TABLE 3

| | | Core A | Core B |
|---|---|---|---|
| Formulation (parts by weight) | Polybutadiene rubber | 100 | 100 |
| | Zinc acrylate | 29 | 32 |
| | Peroxide | 1.2 | 1.2 |
| | Antioxidant | 0.1 | 0.1 |
| | Zinc oxide | 26.7 | 21 |
| | Zinc salt of pentachlorothiophenol | 0.2 | 0.2 |
| | Pigment 1 (yellow) | 1 | |
| | Pigment 2 (blue) | | 1 |

Details of the ingredients in Table 3 are given below.

| | |
|---|---|
| Polybutadiene rubber: | Available under the trade name "BR01" from JSR Corporation |
| Peroxide: | Mixture of 1,1-di(t-butylperoxy)cyclohexane and silica, available under the trade name "Perhexa C-40" from NOF Corporation |
| Antioxidant: | Available under the trade name "Nocrac NS-6" from Ouchi Shinko Chemical Industry Co., Ltd. |
| Pigment 1: | Available under the trade name "RESINO YELLOW 3GR #55 (LB)" from Resino Color Industry Co., Ltd. |
| Pigment 2: | Available under the trade name "RESINO BLUE RT-K (LB)" from Resino Color Industry Co., Ltd. |

Next, using the materials formulated as shown in Table 4, an intermediate layer having a thickness of 1.45 mm was injection-molded over Cores A and B in accordance with a conventional method, thereby fabricating spheres (preformed bodies) A and B composed of a single intermediate layer formed over a core. At this time, REF-10RM which exhibits a red color when exposed to ultraviolet radiation was included as the inorganic phosphor in intermediate layer A, and REF-10GM which exhibits a green color when exposed to ultraviolet radiation was included as the inorganic phosphor in Intermediate Layer B. Above Cores A and B both appeared white under sunlight or fluorescent lighting. Also, Intermediate Layer A was combined with Core A, and Intermediate Layer B was combined with Core B. Because Core A and Core B were colored different colors and thus easily distinguishable, no mistakes were made in combining the cores and the covers.

TABLE 4

| | | A | B |
|---|---|---|---|
| Formulation (parts by weight) | Surlyn 6320 | 60 | 60 |
| | Nucrel N035C | 40 | 40 |
| | Magnesium stearate | 69 | 69 |
| | Magnesium oxide | 0.8 | 0.8 |
| | Inorganic phosphor 1 | 1 | |
| | Inorganic phosphor 2 | | 1 |

Details on the ingredients in Table 4 are given below.

| | |
|---|---|
| Surlyn 6320: | An ionomer resin available from E.I. DuPont de Nemours & Co. |
| Nucrel N035C: | An ethylene-methacrylic acid-acrylic acid ester copolymer available from DuPont-Mitsui Polychemicals Co., Ltd. |
| Inorganic Phosphor 1: | REF-10RM (red-emitting), available under the trade name Hikari ☆Color from TDO Graphics |
| Inorganic Phosphor 2: | REF-10GM (green-emitting), available under the trade name Hikari ☆Color from TDO Graphics |

Next, using materials formulated as shown in Table 5, in accordance with ordinary practice, three-piece solid golf balls were produced by using an injection molding process to form a cover having a thickness of 1.25 mm over the above preformed bodies A and B. Cover A was paired with preformed body A, and Cover B was paired with preformed body B. The white preformed bodies A and B were each easily distinguishable from among a large number of mixed preformed bodies by the respective fluorescent colors they gave off when exposed to ultraviolet radiation. As a result, no mistakes were made in combining the preformed bodies with the covers. The resulting golf balls all had a bright orange color with a transparent feel, and were highly stylish.

TABLE 5

| | | Cover A | Cover B |
|---|---|---|---|
| Formulation (parts by weight) | Himilan 1605 | 50 | |
| | Himilan 1706 | 50 | |
| | Himilan 1557 | | 50 |
| | Himilan 1601 | | 50 |
| | Organic pigment (orange) | 0.98 | 0.98 |

Details of the ingredients in Table 5 are given below.

| | |
|---|---|
| Himilan 1605, 1705 1557, 1601: | Ionomer resins available from DuPont-Mitsui Polychemicals Co., Ltd. |
| Organic pigment (orange): | Available under the trade name "COL036-2774" from DIC Bayer Polymer, Ltd. |

The invention claimed is:

1. A method of manufacturing a golf ball having a core, a cover and, optionally, one or more intermediate layer between the core and the cover, which cover is formed of a transparent or translucent material or a material obtained by blending a colorant in a transparent or translucent material, the method comprising the steps of:

fabricating a preformed body which is a core or a sphere comprising a core over which one or more intermediate layer has been formed;

transferring the preformed body to a temporary storage place;

selecting a preformed body matching a cover to be formed from among a plurality of preformed bodies stored at the temporary storage place;

transferring the selected preformed body to a cover-forming step;

forming a cover over the preformed body transferred from the temporary storage place;

in the preformed body fabricating step, including in or coating onto the preformed body a fluorescent material that fluoresces when exposed to ultraviolet radiation; and in the preformed body selecting step, exposing the preformed bodies stored at the temporary storage place to ultraviolet radiation so as to generate a fluorescent color, and identifying by the color a preformed body matching the cover to be formed.

2. The golf ball manufacturing method of claim 1, wherein the preformed body is a body selected from the group consisting of:

a core formed of a material containing a fluorescent material;

a sphere obtained by forming one or more intermediate layer over a core, wherein an outermost intermediate layer is formed of a material containing a fluorescent material;

a core which has been coated on all or part of a surface thereof with a material containing a fluorescent material; and a sphere obtained by forming one or more intermediate layer over a core, wherein an outermost intermediate layer has been coated on all or part of a surface thereof with a material containing a fluorescent material.

3. The golf ball manufacturing method of claim 2, wherein the preformed body is a core formed by a rubber composition including cis-1,4 polybutadiene having a cis structure content of at least 40% as a base rubber, and the rubber composition contains the fluorescent material in an amount of from 0.1 to 5 parts by weight per 100 parts by weight of the base rubber.

4. The golf ball manufacturing method of claim 2, wherein the preformed body is a core formed by a rubber composition including cis-1,4 polybutadiene having a cis structure content of at least 40% as the base rubber, and the core is formed of a rubber composition which is comprised of:

a fluorescent material in an amount of from 0.1 to 5 parts by weight per 100 parts by weight of the base rubber, an organic peroxide in an amount of from 0.1 to 5 parts by weight per 100 parts by weight of the base rubber, and a metal salt of an unsaturated fatty acid in an amount of from 10 to 50 parts by weight per 100 parts by weight of the base rubber.

5. The golf ball manufacturing method of claim 4, wherein the organic peroxide is one or more material selected from the group consisting of 1,1-bis-t-butylperoxy-3,3,5-trimethylcyclohexane, dicumyl peroxide, di(t-butylperoxy)-meta-diisopropylbenzene and 2,5-dimethyl-2,5-di-t-butylperoxyhexane.

6. The golf ball manufacturing method of claim 4, wherein the metal salt of an unsaturated fatty acid is zinc acrylate.

7. The golf ball manufacturing method of claim 2, wherein the preformed body is a body selected from the group consisting of:

a core which has been coated on all or part of a surface thereof with a material containing a fluorescent material; and a sphere obtained by forming one or more intermediate layer over a core, wherein an outermost intermediate layer has been coated on all or part of a surface thereof with a material containing a fluorescent material;

wherein all or part of a surface of the preformed body is coated with a paint containing a fluorescent material in amount of from 0.1 to 50 parts by weight per 100 parts by weight of the paint.

8. The golf ball manufacturing method of claim 2, wherein the preformed body is a sphere obtained by forming one or more intermediate layer over a core, wherein an outermost intermediate layer is formed of a material containing a fluorescent material, and the outermost intermediate layer is formed by a resin material containing the fluorescent material in an amount of from 0.1 to 5 parts by weight per 100 parts by weight of a base resin.

9. The golf ball manufacturing method of claim 8, wherein the resin has a melt flow index, which is at least 0.5 g/10 min, and the resin has a material hardness, expressed as the Shore D hardness, which is at least 40.

10. The golf ball manufacturing method of claim 1, wherein the fluorescent material is one or more material selected from among inorganic phosphors containing an element selected from the group consisting of alkaline earth metals, zinc family elements, transition metals and lanthanide metals, and organic phosphors selected from the group consisting of compounds having fluorene skeletons.

11. The golf ball manufacturing method of claim 10, wherein the inorganic phosphor includes as the primary ingredient a high-purity oxide, sulfate, silicate or tungstate of zinc, cadmium, calcium, aluminum or yttrium, and is obtained by adding small amounts of an activator of manganese, silver, copper or lead and a flux, and firing at an elevated temperature.

12. The golf ball manufacturing method of claim 10, wherein the inorganic phosphor is at least one of red-emitting inorganic phosphors selected from the group consisting of $Y_2O_3$:Eu, $YVO_4$:Eu, $Y_2O_2S$:Eu, $Y_2O_2S$:Eu,Sm and $0.5MgF_2.3.5MgO.GeO_2$:Mn; green-emitting inorganic phosphors selected from the group consisting of ZnS:Cu,Al, (Zn, Cd)S:Cu,Al, ZnS:Cu,Au,Al, $3(Ba,Mg)O.8Al_2O_3$:Eu,Mn and $Zn_2GeO_4$:Mn; blue-emitting inorganic phosphors selected from the group consisting of ZnS:Ag, $CaWO_4$, $Sr_2P_2O_7$:Eu, and $3(Ba,Mg)O.8Al_2O_3$:Eu; violet-emitting inorganic phosphors comprising CaS:Bi; yellow-green-emitting inorganic phosphors comprising ZnS:Cu; and orange-emitting inorganic phosphors comprising ZnS:Mn.

* * * * *